US006207032B1

(12) United States Patent
Buchanan

(10) Patent No.: US 6,207,032 B1
(45) Date of Patent: Mar. 27, 2001

(54) ELECTROSTATIC/MECHANICAL EMULSION TREATING METHOD AND APPARATUS

(75) Inventor: Vincent P. Buchanan, Bakersfield, CA (US)

(73) Assignee: Kvaerner Process Systems, Inc. (CA)

( * ) Notice: Subject to any disclaimer, the term of this patent is extended or adjusted under 35 U.S.C. 154(b) by 0 days.

(21) Appl. No.: 09/164,813

(22) Filed: Oct. 1, 1998

(51) Int. Cl.[7] ..... B03C 5/02
(52) U.S. Cl. ..... 204/660; 204/666
(58) Field of Search ..... 204/302, 660, 204/400, 188, 562, 563, 644, 666; 422/186.04; 210/97, 121, 122, 123, 124, 134, 135

(56) References Cited

U.S. PATENT DOCUMENTS

| | | | | |
|---|---|---|---|---|
| 2,478,934 | * | 8/1949 | Morse | 204/299 |
| 2,892,768 | * | 6/1959 | Waterman | 204/304 |
| 4,329,159 | | 5/1982 | Bull . | |
| 4,702,815 | * | 10/1987 | Prestridge | 204/302 |
| 4,919,777 | * | 4/1990 | Bull | 204/188 |
| 5,256,270 | * | 10/1993 | Tokumoto | 204/302 |
| 5,529,675 | * | 6/1996 | Adamski | 204/400 |
| 5,759,390 | * | 6/1998 | Essop | 210/221.2 |

* cited by examiner

*Primary Examiner*—Kathryn Gorgos
*Assistant Examiner*—J. Maisano
(74) *Attorney, Agent, or Firm*—James G. O'Neill

(57) ABSTRACT

A treater for electrostatically and/or mechanically separating emulsified brine from oil during longitudinal flow through a horizontally elongated metal tank, wherein adjustable distributor elements are provided for enhancement of the de-emulsification process. The adjustable distributor elements may be externally operated to more closely control the diffusion and distribution of the flowing emulsion across the transverse area of the treater. The emulsion may be first directed through electrical fields where the brine droplets take on an electrical charge, then move through the distributor elements to electrically grounded coalescing elements. De-emulsified oil is removed in a stream separate from the brine stream. The treater also operates mechanically, with reduced efficiency, when electrostatic operation is unavailable, and can also be operated if coalescing elements are not used. The externally-adjustable, louvered baffles may be accompanied by fixed, non-adjustable louvers at intermediate spacing between the externally-adjustable louvers to provide additional coalescing and flow direction that will enhance dehydration of the process stream, and become an integral extension component thereof.

9 Claims, 4 Drawing Sheets

ELECTROSTATIC/MECHANICAL EMULSION TREATING METHOD AND APPARATUS

BACKGROUND OF THE INVENTION

1. Field of the Invention

This invention relates generally to emulsion treating, and, more particularly, to an emulsion treating apparatus and method which enables a plurality of distributors to be externally adjusted to more accurately control the treatment of the emulsion flowing through the treater.

2. Description of Related Art

Petroleum as it is naturally produced from an underground formation, is, in most cases, a mechanical mixture of oil, entrained gas and produced water, some of which latter may be present as an oil/produced water emulsion. It is desirable, and usually necessary to treat the petroleum thus produced at the wellhead, for the separation and removal of the entrained gas and emulsified produced water, in order to render the oil pipelinable. Usually, the separated produced water (salt water, heavy mineralized water or fresh water) is pumped back into the formation, in order to assist in maintaining the pressure therein, and also to resolve the produced water disposal problem. Separated gas is vented or flared, if in small quantities, and if in commercial volumes, is delivered to a pipeline for distribution. The equipment used for this three-phase separation is known as a treater, and is generally quite familiar to those whom the present invention will be addressed.

Such treaters normally involve the heating of the produced petroleum, in order to lower the viscosity of the fluid phase, and also to assist in the separation of the entrained gas. Brine droplets are coalesced either mechanically, as by forcing the emulsion through a series of perforated baffles; or electrostatically, as by forcing the emulsion through a highenergy, electrically charged field; or chemically, by means of surface-active chemical agents which reduce the surface tension on the water droplets, thereby allowing them to coalesce into larger drops for separation by gravity. Frequently, two or more coalescing methods are employed in a treater.

Treaters have evolved in design from early developed open vats, which maintained the produced petroleum in stationary condition for several days, permitting the produced water to separate to the bottom of the vat by gravity. There evolved heating methods in order to expedite the treatment by reducing the viscosity of the oil, as described. Subsequent development evolved the heater-treater which is the current state-of-the-art comprising an elongated enclosed tank having a burner-fired heater section and a downstream treater section for continuous flow, with a series of perforated baffles positioned within the treater section transversely to the flow of fluids; the perforated baffles function to promote the even distribution over the full cross-sectional area of the treater section of the fluids in motion, and to cause a pressure drop within the fluid across the perforated baffles which results in a release of entrained gasses, which then collect in the upper volume of the tank for removal. However, produced water emulsions within the oil have continued to be inefficiently treated by gravity settling and baffling of the flow following heating; thus, further measures have been necessary in order to cause coalescing of the small droplets of produced water into larger drops which could be settled out by gravity.

The conventional treatment has the operational disadvantages of being time-consuming, due the residence time required in the treater and the requirement that the petroleum be heated to a sufficiently high temperature to reduce the viscosity thereof so that coalescing of the emulsified droplets will be encouraged. The maintenance of a large quantity of oil at a relatively high temperature is costly of energy, and requires the equipment involved to be capable of sustained operation at the temperatures involved.

Treaters in current use are normally tanks in the form of elongated, horizontal cylinders divided by means of internal partitions into compartments through which the petroleum will sequentially flow. Burner-fired heaters are normally include in the upstream heater section for heating the emulsion to the desired temperature, during which most of the entrained gas and some of the brine will separate from the emulsion. The partially-de-emulsified brine then flows into a treater section, in substantially gas-free state, encountering a series of baffles adapted to encourage even flow of fluids and to avoid the formation of flow channels within the fluid body, thereby to assist in separation of remaining gases and coalescing of produced water droplets, and their separation by gravity to the bottom of the tank for ultimate discharge removal.

Various techniques of improvement have heretofore been employed in order to minimize treatment time and heat energy consumption. In U.S. Pat. No. 4,329,159 to Bull, there is described a method and apparatus of the type described, additionally including a number of metallic apertured grid electrodes suspended adjacent apertured baffles, the electrodes being supplied with electrical energy. A series of longitudinally spaced electrical fields of high potential and density are thereby created, which cause droplets of emulsified brine to move in violent random fashion, the droplets coalescing and collecting into drops of sufficient weight so as to fall by gravity to the lower portion of the treater water phase section for removal.

While the addition of the electrostatic elements described in U.S. Pat. No. 4,329,159 resulted in enhanced separation of the oil and brine, a further improvement to this patent was set forth in U.S. Pat. No. 4,919,777 to Bull, in which a series of coalescer or collector elements are positioned within the treater compartment, each in immediate downstream relationship from an electrostatic element, the coalescer element being electrically grounded to the tank thereby causing the brine droplets to be attracted to the coalescer element where coalescing into brine drops occurs, followed by gravity collection and removal.

Even when electricity is not economically available, the U.S. Pat. No. 4,919,777 patent operates as a mechanical (non-electrostatic) treater in which a brine de-emulsifying element consisting of a bundle of open-ended tubes having foreshortened vertical dimensions positioned downwardly inclined in the direction of flow. Individual tubes present opposition to the flow of emulsion for contact between the brine droplets of the emulsion and the interior surfaces for accumulation and downward trickling by gravity to a sump for collection and removal. Each such tube having a diameter of approximately one inch and a length of approximately one foot, brine droplets moving forwardly with the emulsion and passing through the open-ended passages of the collector elements will be separated from the emulsion by contact with and adhesion to the interior surfaces of the tubes. Contact with a surface of one of such tubes will be facilitated in accordance with Stokes Law of Fluid Flow.

The present invention provides a still further improvement to those disclosed above, resulting in enhanced separation of oil from brine in an emulsion, by replacing the perforated baffles with externally operated, adjustable, vertical louvered distribution baffles which can accommodate a wide range of crude oils, operating at various pressures and temperatures, under a wide variety of flow conditions.

In presently existing equipment, if a different viscosity oil having varying produced water content is to be treated, or if the existing equipment becomes clogged or is somehow rendered inoperative, the equipment must be shut down, allowed to cool off, opened and then cleaned or new components installed, under stringent environmental and safety constraints. Such shutdowns are expensive and time consuming, and, therefore, needed adjustments, cleaning, and/or required service, are often put-off, thereby producing undesirable results, and subjecting the equipment to unneeded stress and breakdowns.

In the method and apparatus of the present invention, externally adjustable, vertical louvered baffles or distributors replace the perforated baffles in the treater section, and are suspended in the emulsion downstream or upstream of any electrostatic grid and upstream of any coalescer elements, to more accurately control the flow of emulsion as it moves through the treater section.

SUMMARY OF THE INVENTION

It is, therefore, a general object of the present invention to provide an improved method and apparatus to treat an emulsion. It is a principal object of the present invention to provide an apparatus and method for more accurately treating emulsions to obtain substantially complete separation of produced water and gas from the oil in acceptable time and with a lesser consumption of energy, using smaller, more compact, cost effective units with the capability, but not the necessity, of using electrostatic elements and/or additional coalescers. Another object of the present invention is to effect the coalescing of droplets of produced water in the emulsion by more accurately controlling the flow of the emulsion to thereby achieve substantially complete separation of produced water from the oil. It is a yet further particular object of the present invention to provide an apparatus for separating oil, produced water and gas from an emulsion, comprising a generally horizontal separating vessel including means for variably controlling the flow of the emulsion through the vessel, as well as any electrical field and/or a collector means which might be used. And, it is a further object of the present invention to provide variably controlled means operated by means mounted externally of a horizontal separating vessel, to improve the separation process.

These and other objects of the present invention are achieved by providing a horizontal vessel comprised of a one or two-section treater. In a two section vessel, there will be a first heater section and a downstream treater section having at least one distributor element suspended in the treater section across the flow path of an emulsion, which distributor element is comprised of a plurality of adjustable louvers mounted therein, operated by a device extending through the vessel to the exterior thereof.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENTS

Figure 1:
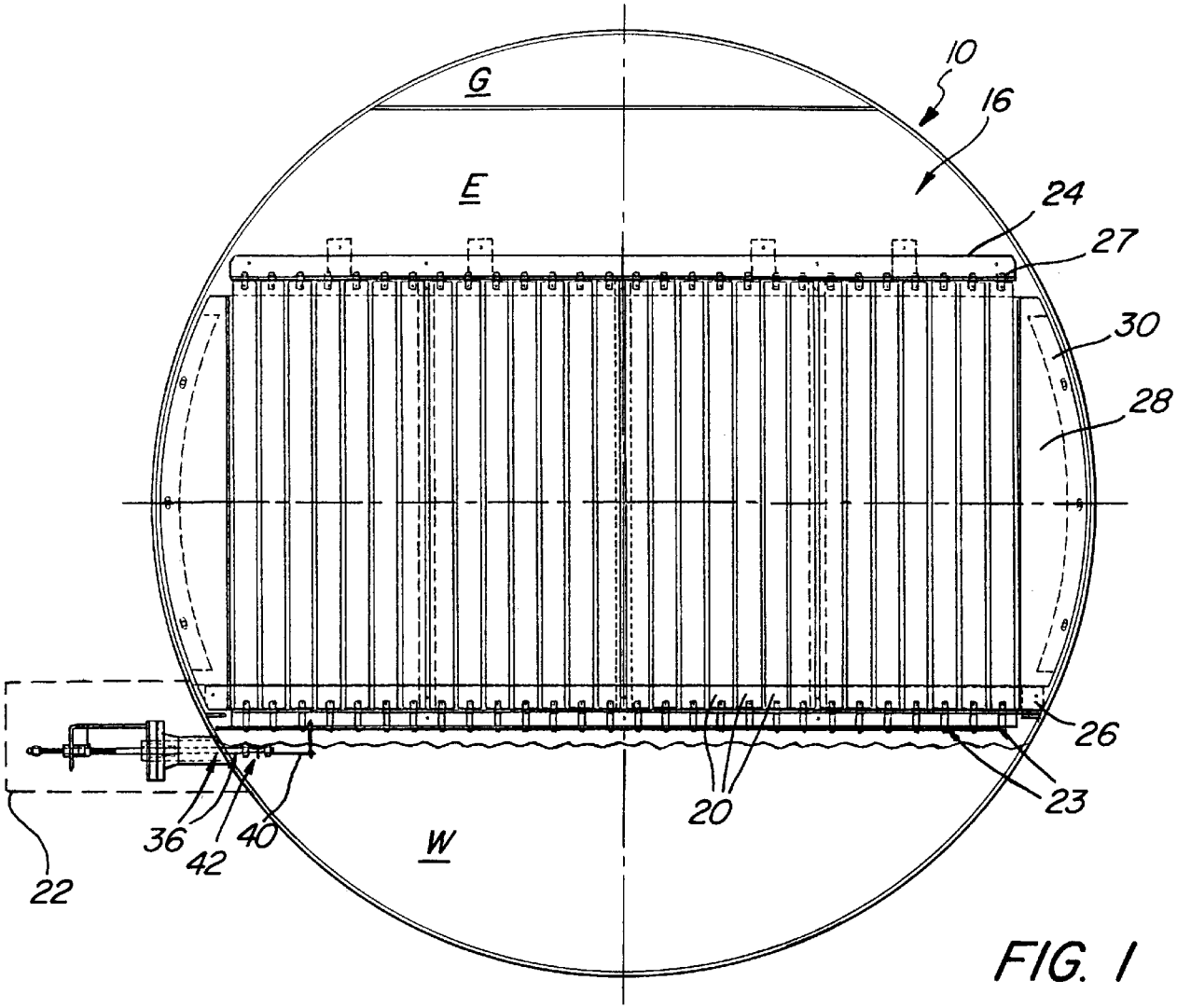
FIG. 1 is a cross-sectional view through the treatment section of an oil treater showing one embodiment of a plurality of distributors of the present invention, in the closed position.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to describe an improved and simplified emulsion heater-treater (hereinafter referred to as a "treater"), having a mechanical distributor and coalescer, which may be easily and quickly controlled from the exterior of a treater vessel, so as to adjust for and/or compensate for differences in the various parameters of emulsions moving through the treater.

The present invention is an improvement to the apparatus and methods set forth in U.S. Pat. Nos. 4,329,159 and 4,919,777, the disclosures of which two patents are incorporated herein, in their entirety, by this reference thereto.

While treatment of crude oil is described as the primary use for this invention, it is to be understood that it is also applicable in treating any liquid medium or process that utilizes gravity settling or separation, and/or coalescing that requires flow metering control for both vertical, diagonal or horizontal operation.

Referring now to the drawings, the present invention is utilized in an elongated, horizontal metal tank or vessel 10 of the type disclosed in U.S. Pat. Nos. 4,329,159 and 4,919,777. As best shown in FIGS. 4–7, the elongated vessel 10 has a first heater section 12 and a second treatment or treater section 14, separated by a bulkhead 18. A foam removing assembly 52 is disposed in treating section 14, upstream of the bulkhead 18. A viscous emulsion E to be treated is fed into the upstream end of the heater section 12, or if no heater section is used, directly into the upstream end of the treating section 14, in a manner well known to those skilled in the art. The emulsion then flows through the heater section 12, passed the bulkhead 18 and into the treating section 14, for passage through treating components contained therein. After passing through the treating section 14, the treated emulsion then flows out an outlet, at the downstream end, indicated "O" in FIGS. 4–7.

The apparatus and method of the present invention provide a more efficacious separation of a viscous emulsion E into its respective components, namely, produced water W, gas G and substantially water-free oil 0, which exit the treater section, as shown. This is accomplished by the use of novel diffusion and distribution device 16, in the form of a plurality of sets of distributors having vertically mounted, adjustable louvers 20, which are preferably operated by an element 22 mounted externally of the vessel 10 (see FIGS. 1–3), and extending through the side of the vessel 10, in a fluid-tight manner, into contact with the distributors 16. The distributors 16 of the present invention provide for an improved treater with:

1. the ability to be externally adjusted to accommodate a wide range of A.P.I. gravities of crude oil;
2. the ability to be externally adjusted while the treating unit is in operation, under pressure and at operation temperature;
3. the ability to be externally adjusted to accommodate crude emulsions with unusual viscosity characteristics;
4. the ability to be externally adjusted to compensate for inaccurate engineering sizing, flow calculations, or assumptions;
5. the ability to be externally adjusted to accommodate crude oil flow rates in excess of design conditions;
6. the ability to be externally adjusted to accommodate crude oil flow rates much lower than design conditions and, therefore, increase the turn down ratio;
7. the ability to be externally adjusted to evenly distribute heat throughout the coalescing oil pad;
8. the ability to be externally adjusted to better accommodate surging flow rates;
9. the ability to be externally adjusted from full open to full closed, therefore, dislodging any plugging that may have existed at normal operating settings;
10. the ability to be externally adjusted to precisely control oil-water cuts.

The externally adjustable louvered baffles of the present invention allow metering of process flow and provides increased coalescing surfaces by the following operation: as the process flow impinges on the surface of louvers, coalescing of the water droplets increases due to increased collisions. As the louvers are opened to meter the flow, counter rotating vortices develop as the process flow is restricted due to the flow limiting size of the opening in the louvers. The resulting pressure wave buildup on the upstream side of the funnel formed by the two slats, combined with the accelerated flow of the center process stream, form a vortex and a pressure drop across the louvers. While the trailing edge of the slats provides a combing effect that funnels the coalesced water droplets into a laminar stream as they flow past, much like you would see as water vapor trails of the trailing edge of an airplane wing when passing through water vapors or rain. Each pair of vertical louvers establish a rotating effect since the louvers limit the flow by being partially closed, oil must circulate against the face of the louvers waiting its time to flow through the opening, thus exposing additional flow to the coalescing surfaces of the louvers and increasing coalescing efficiency. The counter, slow-rotating vortices continue well downstream of the baffles, creating a gentle swirling and mixing action that enhances the probability of massive water droplet collisions, and prevents formation of laminar flow or stratification of the process flow, thus enhancing water droplet coalescing. Since this is occurring over the entire length of the vertical louver, the water droplet's mass is increased by both the horizontal and vertical collisions.

The vertical design of the louvers causes a fine sheeting action that provides laminar flow pathways (or super highways) for the water to transverse the oil pad into the water phase. As the water droplets masses increase due to actions described above, so does their velocities. By the time the water droplets reach the bottom of the louvered baffle, they have reached their terminal velocity due to their increased mass, and they easily transverse the remainder of the oil pad. This decreases the time and distance required to remove the emulsified water from the process stream thus allowing for smaller, less expensive treating vessels. This is extremely important in offshore applications where real-estate is at a premium.

The present invention also enables external reconfiguration of internal flow distribution, flow metering and coalescing elements to treat varying API° gravity crude oil from 10° API to 40° API without costly shutdowns and internal baffling modifications required in current technology, and can be adapted for vertical flow treating applications, as both a mechanical coalescer and as the return side grid on electrostatic grids. It also provides electrostatic grids ground return function on each of the rotatable vertical louver elements for electrostatic operation, and allows for fine tuning of the electrostatic field for maximum electrostatic field strength.

The vertical louvers provide a slicing action to the process stream, exposing greater surface area of the process stream to a greater area of coalescing surface, that in turn removes more water from the oil, and increases dehydration efficiency. The addition of fixed, non-adjustable, vertical louvers, spaced at intermediate positions between the externally-adjustable, louvered baffles, increases the coalescing surface area.

Reduction in treating vessel size is a major advantage to the present invention, by formation of multiple, variable vortexes by the adjustability of the louvered baffles. These vortices are a major element of the invention. In addition, these louvered baffles may be coupled with centrifugal inlet devices that utilize vortex separation technology to enhance treating capabilities.

Various types, textures and shapes can be used as louver baffle slats depending on API° crude oil under treatment. These shapes and textures aid in increasing coalescing surface area and efficiency, by providing a more torturous flow path with shapes and increased coalescing surface friction with surface textures. These louvered baffles are utilized as an integral part of any electrical field treating system, such as electrostatic, electromagnetic, magnetic, direct current half wave or full wave, alternating current, variable frequency and or pulsed electrical field design systems. Additionally, the adjustability of the externally adjustable louvered baffles may be manual or automatic. In automatic mode, it can be coupled with real time monitoring of the process stream to compensate for varying process conditions in real time. This adjustability of the louvers to an infinite number of positions by varying the size of the opening, allows for increased or decreased flow velocities and aids or impedes downstream vortex mixing action. The externally-adjustable, louvered baffles may be mounted in a vertical, diagonal or horizontal position, depending on processor requirements.

Figure 2:
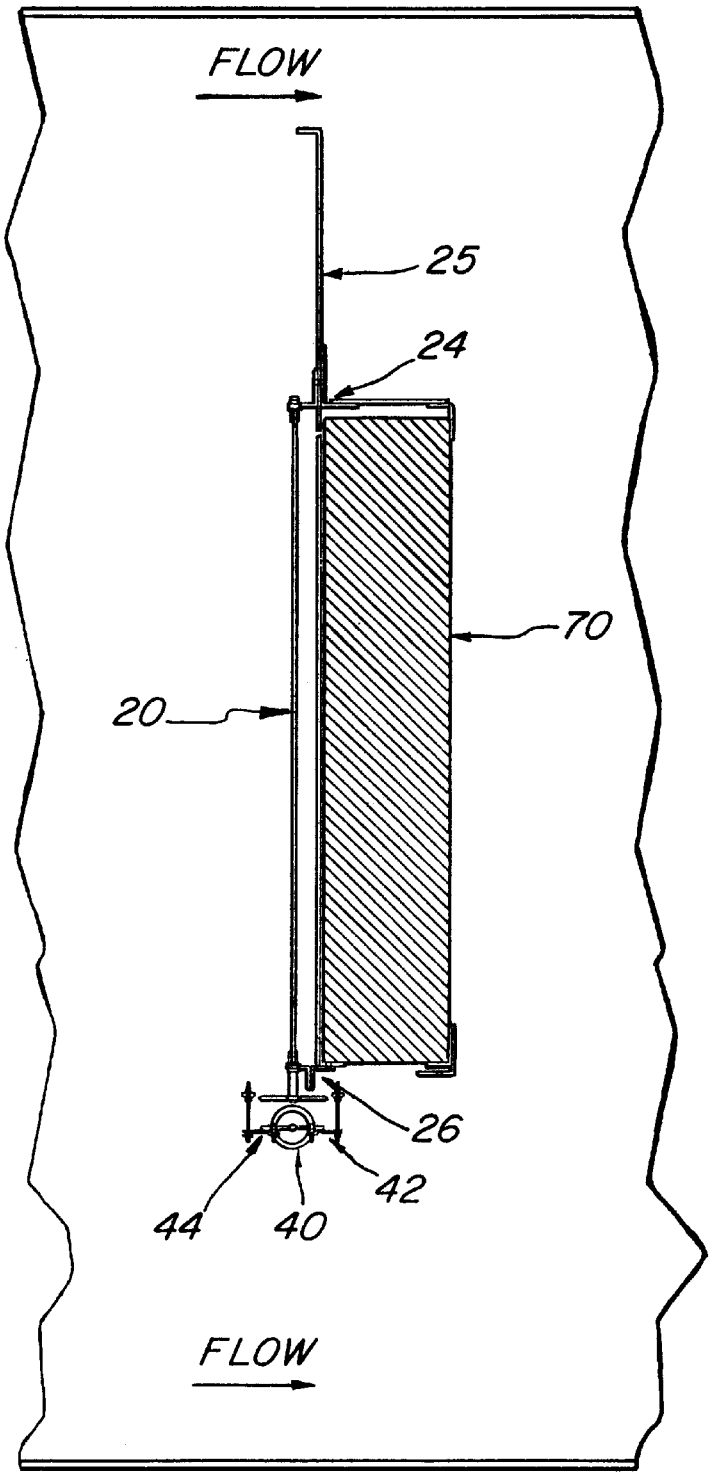
FIG. 2 is a partial side elevational view of the distributors of FIG. 1, in the closed position.
Figure 3:
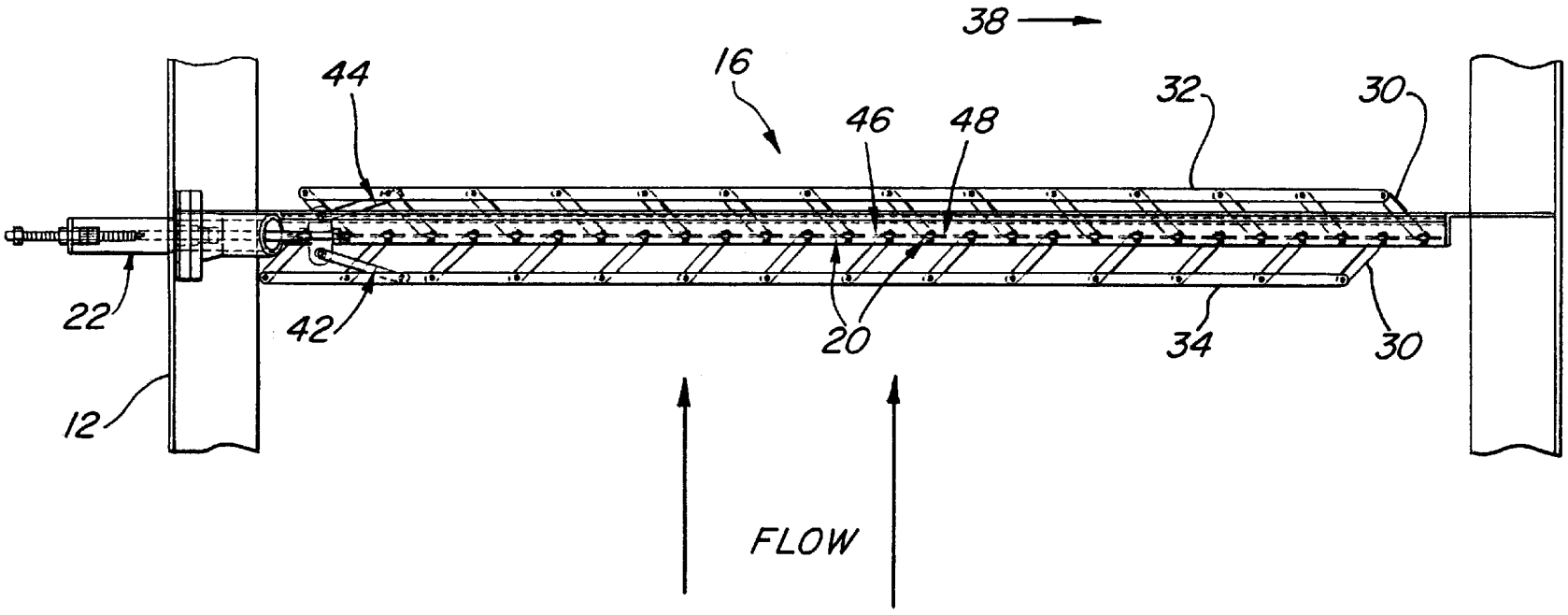
FIG. 3 is an enlarged partial view of the bottom of the distributors of FIG. 2 in the open position.
Figure 4:
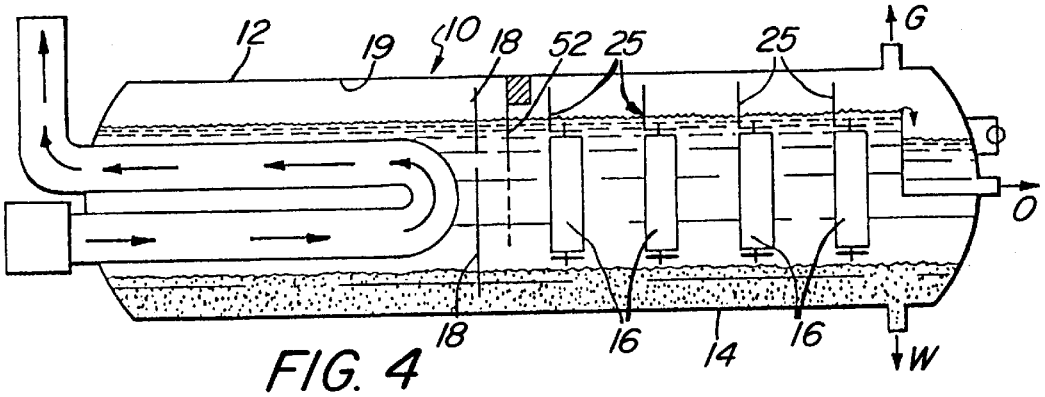
FIGS. 4–7 are schematic cross-sectional views of variously equippedelectrostatic/mechanical/coalescerheater-treaters, having a plurality of externally operated distributors of the present invention therein.
Figure 5:
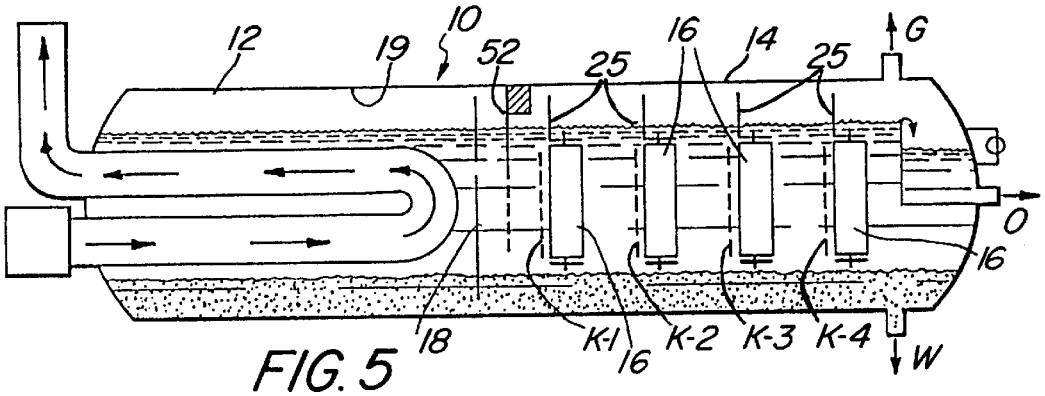
Figure 6:
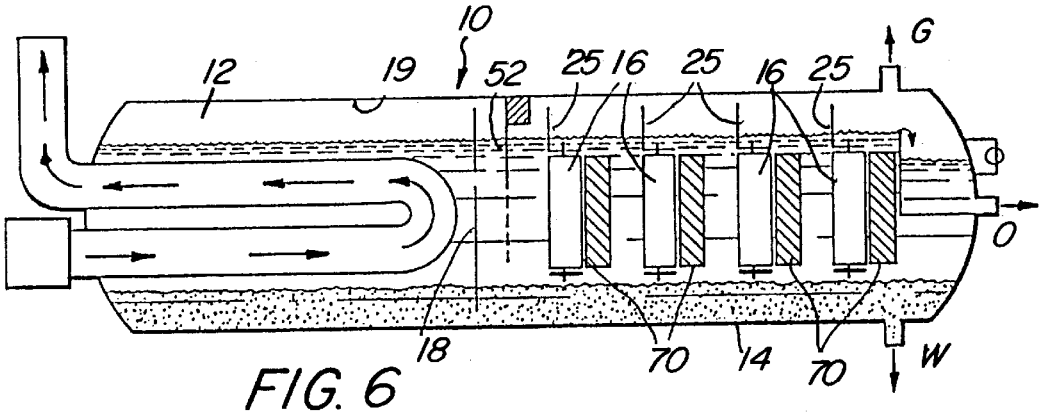
Figure 7:
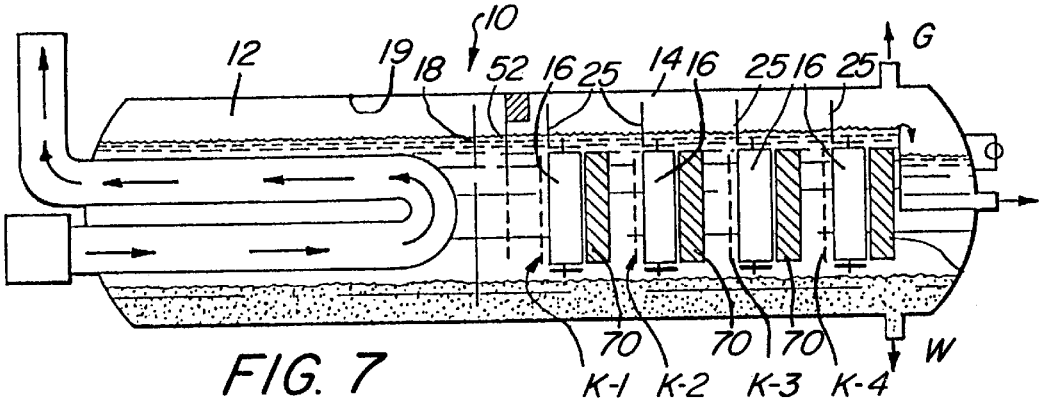

Each distributor 16 of the present invention used in the treater may be extended down into the lower produced water phase, without a plugging problem. Furthermore, as shown in the examples illustrated in FIGS. 4–7, four (4) distributors 16 may be located in the treatment section 14, adjacent coalescer elements 70, if used (FIGS. 2, 6 and 7), to replace the perforated baffles used in the prior art. As best shown in FIGS. 1–3, each of the distributors 16 is comprised of a plurality of adjustable louvers 20 longitudinally spaced across the width of the treatment section 14. Each set of adjustable louvers stretches substantially the entire distance across the emulsion flow, between opposed sides of an inner wall 19 of the vessel 10, and are supported in top and bottom channels 24, 26, as by means of shafts 27, 29, rotatably held in the channels 24, 26. The side edges and top of the distributors 16 include transverse baffles or walls 28, 30 adapted to conform to the inner curvature of opposed sides of the inner wall 19 of the vessel and a top or wave baffle 25 to control the flow of the slowly moving emulsion E through the louvers 20, uniformly across the width of the vessel 10. If desired, as shown in FIGS. 5 and 7, electrode grids K-1 to K-4 supported by electrically insulated brackets, or the like, may be provided within the tank 10 immediately upstream of each transverse set of rotatable distributors 16. Alternately, as shown in FIG. 6, coalescing elements 70, electrically grounded to the tank 10 may be provided immediately downstream of each set of rotatable distributors 16.

If an electrostatic grid system is available, and more complete treatment of the emulsion is required, as shown in FIG. 7, electrode grids K-1 to K-4 may be mounted immediately upstream of each set of rotatable distributors 16, and coalescing elements 70 may be mounted immediately downstream of each set of rotatable distributors.

Turning now to FIGS. 1–3, the preferred embodiment of the externally operated, rotatable louvers 20 in each set of distributors 16 will be described. Each of the distributors is supported in a predetermined position in the vessel, and the adjustable louvers 20 are supported therein by ends walls 28, 31, top and bottom channels 24, 26 and at least one support rod 25. Furthermore, each of the separate louvers 20, within a distributor 16 is adjustable about an axis, defined by shafts 27, 29, by a mechanical device 30, such as lever arms or links, secured between the lower shafts 29 and a pair of sliding elements 32, 34, such as bars or rods, shown in FIG. 3. In the closed position, as shown in FIG. 1, the louvers 20 substantially block flow of emulsion E through the distributor 16, and, therefore, the vessel 10. However, upon operation of the external operator 22, either manually or by an automated, powered system, the operator 22 will move or translate a shaft 36, inwardly, to move or push a coupling elements 40, which is connected to a further pair of connecting elements 42, 44, pivotably connected between linkage 40 and rods 32, 34, to move rods 32, 34 in the direction of arrows 38, to rotate the links 30, and, therefore, the louvers 20, in the direction of the arrows 46, 48 (see FIG. 3), a desired amount, so as to control the flow of emulsion through the distributors 16. Preferably, the louvers 20 are operated in pairs, as shown in FIG. 3. That is, a first pair of louvers opens in a first direction with or against the flow, and the next pair opens in the opposite direction, against or with the flow, with each further pair alternating in the direction of opening in the same manner, to thereby control flow of emulsion therethrough.

Depending on the viscosity and other parameters measured in the vessel 10, the distributors 16 may each be precisely, externally adjusted to rotate the louvers 20 to the desired open position to provide the best possible results, consistent with real time measurements, as the emulsion E moves through the treating section 14 of the vessel.

It, therefore, can be seen that the adjustable louvers in the distributors of the present invention, when used alone or in conjunction with electrostatic elements and/or additional coalescers, will provide greater control, producing improved results, which were heretofore impossible to obtain.

Those skilled in the art will appreciate the various adaptations and modifications of the just-described preferred embodiments can be configured without departing from the scope and spirit of the invention. Therefore, it is to be understood that, within the scope of the appended claims, the invention may be practiced other than is specifically described herein.

What is claimed is:

1. In an emulsion separating treater for separating emulsified produced water droplets from an emulsion which includes a generally elongate metal tank constructed and arranged for flow of the emulsion therethrough from a first inlet end to a second outlet end, comprising:

a plurality of pairs of liquid diffusion and distribution elements disposed within the generally elongate metal tank transversely to the flow of emulsion, the plurality of pairs of liquid diffusion and distribution elements including a plurality of pairs of adjustable louvers to more accurately control the distribution and diffusion of flow of emulsion through the separating treater; and an operating element for moving the plurality of pairs of adjustable louvers being mounted exteriorly of the generally elongate metal tank and being connected to a lever-and-link system to separately move each of the plurality of pairs of adjustable louvers; the lever-and-link system being movable within the generally elongate metal tank, and including a first operating member, connected to a linkage, which linkage is further connected to a pair of arms connected to a pair of parallel rods, which pair of parallel rods separately move each of the pairs of adjustable louvers by means of a plurality of links rotatably connected between the pair of parallel bars and a rotatable shaft of an adjustable louver, whereby the plurality of links and pair of parallel bars move adjacent pairs of louvers in opposite directions.

2. The treater of claim 1, further including a plurality of sets of the plurality of pairs of adjustable louvers in the generally elongate metal tank, and wherein the generally elongate metal tank is horizontal and includes a first heater section and a second treater section.

3. The treater of claim 2, further including electrostatic grids mounted in the generally elongate horizontal metal tank, upstream of each of the plurality of sets of the plurality of pairs of adjustable louvers.

4. The treater of claim 2, further including at least one coalescing device disposed within the generally elongate horizontal metal tank in downstream relationship to at least one of the plurality of pairs of adjustable louvers.

5. An emulsion separating treater for separating water droplets from oil in an emulsion, the treater including a generally horizontal, elongate metal vessel constructed and arranged for longitudinal flow of the emulsion through a first heater section and a second treater section, comprising:

at least one set of a plurality of pairs of adjustable louvers disposed within the second treater section transversely to the flow of emulsion to control the distribution and flow of the emulsion through the second treater section; and an operating element mounted exteriorly of the generally horizontal, elongate metal vessel and connected to a mechanical actuating means held within the generally horizontal, elongate metal vessel; the mechanical actuating means including a first operating arm, connected to a linkage, which linkage is further connected to a pair of elongated arms connected to a pair of parallel rods, which pair of parallel rods separately rotate each of the pairs of adjustable louvers, through a plurality of links being connected to the at least one set of a plurality of pairs of adjustable louvers to move the at least one set of a plurality of pairs of adjustable louvers.

6. The treater of claim 5 wherein there are a plurality of sets of a plurality of pairs of adjustable louvers and the plurality of links are connected to rotatable shafts of the plurality of pairs of adjustable louvers, and electrostatic grids are mounted in the vessel, upstream of each of the sets of a plurality of pairs of adjustable louvers.

7. The treater of claim 6, further including coalescing devices disposed within the generally horizontal elongate metal vessel in downstream relationship to each of the plurality of sets of a, plurality of pairs of louvers.

8. An emulsion separating treater for separating an emulsion of emulsified produced water droplets and oil, which includes a generally horizontal, elongate metal vessel constructed and arranged for longitudinal flow of the emulsion through a first heater section and a second treater section, comprising:

a plurality of adjustable liquid diffusion and distribution elements having a plurality of pairs of louvers disposed within the second treater section transversely to the flow of emulsion to more accurately control the distribution and flow of the emulsion through the second treater section; and a plurality of operating elements mounted exteriorly of the vessel and connected to mechanical linkage systems mounted within the vessel, which mechanical linkage systems include links connected to the plurality of pairs of louvers, to separately rotate the plurality of pairs of louvers between closed and opened positions.

9. The treater of claim 8, further including an electrostatic field generating elements mounted in the generally horizontal, elongate vessel upstream of each set of the plurality of pairs of louvers; and coalescing elements mounted in the generally horizontal elongate metal vessel downstream of the plurality of pairs of louvers.

* * * * *